US008566992B1

(12) United States Patent
Stokes

(10) Patent No.: US 8,566,992 B1
(45) Date of Patent: Oct. 29, 2013

(54) EXTENDABLE AND RETRACTABLE WORK PLATFORM

(76) Inventor: Patrick Stokes, Youngsville, LA (US)

( * ) Notice: Subject to any disclaimer, the term of this patent is extended or adjusted under 35 U.S.C. 154(b) by 568 days.

(21) Appl. No.: 12/777,059

(22) Filed: May 10, 2010

(51) Int. Cl.
*E01D 1/00* (2006.01)
*B63B 21/08* (2006.01)

(52) U.S. Cl.
USPC ..... 14/69.5; 114/230.17

(58) Field of Classification Search
USPC ..... 14/69.5, 71.1; 114/230.17, 230.18, 362; 182/223; 414/537, 921, 140.1; 104/31
See application file for complete search history.

(56) References Cited

U.S. PATENT DOCUMENTS 2,803,841 A * 8/1957 Wellens ..... 14/71.1
3,008,158 A * 11/1961 Stinson ..... 14/71.1
4,003,473 A * 1/1977 Ryan ..... 14/71.7
4,157,742 A * 6/1979 Aanensen ..... 182/97
4,354,447 A * 10/1982 Hultgren ..... 114/255
4,366,591 A * 1/1983 Zimmerman ..... 14/71.3
4,473,916 A * 10/1984 Connold ..... 14/42
4,620,612 A * 11/1986 Enoki et al. ..... 182/113
5,054,963 A 10/1991 Williamsson
5,367,973 A 11/1994 Heggertveit
6,718,902 B1 * 4/2004 Lower ..... 114/264
6,748,895 B2 * 6/2004 Besenzoni ..... 114/362
6,955,134 B2 * 10/2005 Prins ..... 114/230.17
7,497,494 B1 3/2009 Good
2003/0182741 A1 * 10/2003 Prins ..... 14/71.1
2005/0111947 A1 * 5/2005 Webb et al. ..... 414/537
2005/0220543 A1 10/2005 Sain

* cited by examiner

*Primary Examiner* — Matthew D Troutman

(57) ABSTRACT

A method and apparatus for providing an extendable and retractable work platform from a work vessel is disclosed. The apparatus is comprised of first and second platform support frames with associated decking surfaces. These support frames are configured so that second support frame may be slidably received within the first support frame. The first support frame is mounted to the deck of a work vessel so that the second support frame with associated decking may be moved or "telescopically" extended from the first support frame away from the side of the vessel. The work platform is provided with a plurality of detachable deck extensions as well as detachable hand railing sections. A means to extend and retract the platform is also provided. The decking surface of the work platform may have an opening to provide access to areas below the work platform such as to a well bore or the piping and valve superstructure of a well bore.

3 Claims, 7 Drawing Sheets

EXTENDABLE AND RETRACTABLE WORK PLATFORM

FIELD OF INVENTION

This invention relates to a work platform and method, more particularly, to an extendable and retractable work platform mounted to a boat deck to provide for work crew access over or to a specific location such as a vertically extending pipe stand or to a subsea wellhead that may be used in the offshore production of oil and gas and the like.

BACKGROUND OF INVENTION

Often times it is advisable or necessary to position a work boat or vessel over a predetermined location. In many such situations, underwater debris or obstructions prevent or make it difficult to accomplish such positioning due to threat of damage to the work vessel. Consequently, a need exists for a device and method to position a work platform at a desired position but that will allow a vessel to be positioned away from the work area in order to avoid or reduce the threat of damage to the vessel.

SUMMARY OF INVENTION

The present invention provides an extendable and retractable work platform that may be mounted on the deck of a vessel such as lift boat or type of work boat. When mounted on the deck of a vessel, the work platform may be extended from the side of said vessel to a work area away from the vessel and then retracted back to said vessel as desired.

The apparatus and system is comprised of a support frame having at least a pair of support beams. The support beams of the support frame are configured to slidably receive a slidably mounted and overlapping work platform support frame. The work platform support frame is configured with floor braces to support a floor or work deck to provide a work platform for workers. The work deck has a flooring system which may be comprised of checkered plate decking, bar grating, a combination of checkered plate decking and bar grating, or other suitable flooring systems.

The work platform work deck may have a plurality of work deck platform extensions detachably mounted to the work deck support frame. The work deck may have a system of detachably mounted handrails. The work platform work deck may have an opening to provide access to areas below the work platform such as to a well bore are the piping and valve superstructure of a well bore. The opening, may be covered with flooring such as checkered plate decking or bar grating when access through the work deck is not required.

The work deck is provided with a means to slidably or 'telescopically' extend the overlapping support frame from and along the support beams to a desired position. This will allow the support frame and any attached work deck to be cantilevered and supported by the support beams in a desired position. The means to slidably extend the support frame from and along the support beams may be lug or padeye mounted on the support frame which allows attachment to a line on a crane or wench in order to pull the support frame back and forth along the support beams.

The means to slidably extend the support frame from and along the support beams may also be a hydraulic cylinder having an extending and retractable piston rod that moves the support frame along the support beams. The means to slidably extend the support frame from and along the support beams may also be a wench and pulley configuration that moves the support frame along the support beams.

It is thought that each of the various components of the extendable and retractable work platform will be constructed from structural steel components and that the decking on the work platform will have non-skid surfaces. However, other types of materials and metals might be utilized to construct the work platform and system.

DESCRIPTION OF THE DRAWINGS

Figure 1:
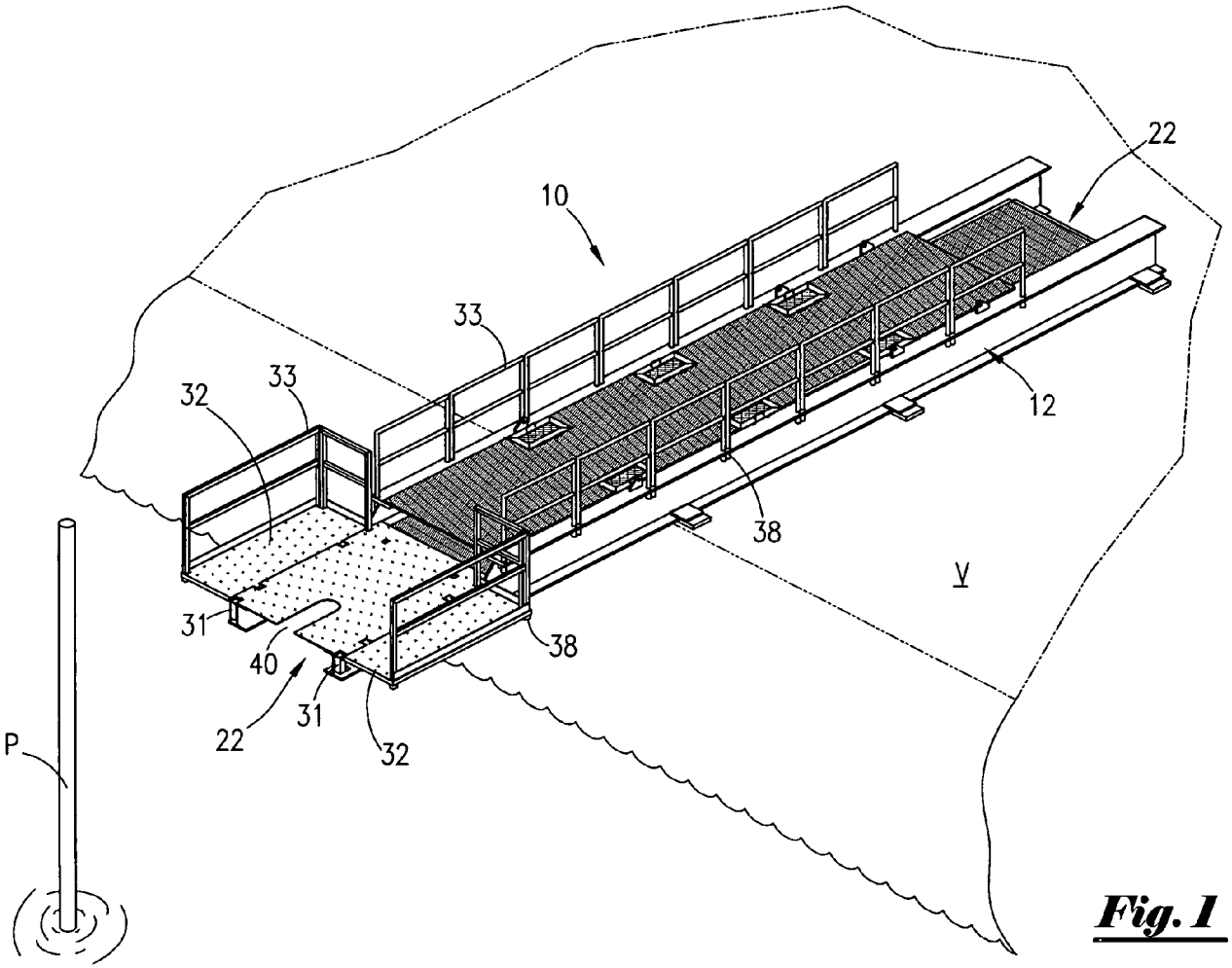
FIG. 1 is a perspective view of the extendable and retractable work platform of the present invention mounted on a work vessel.
Figure 2:
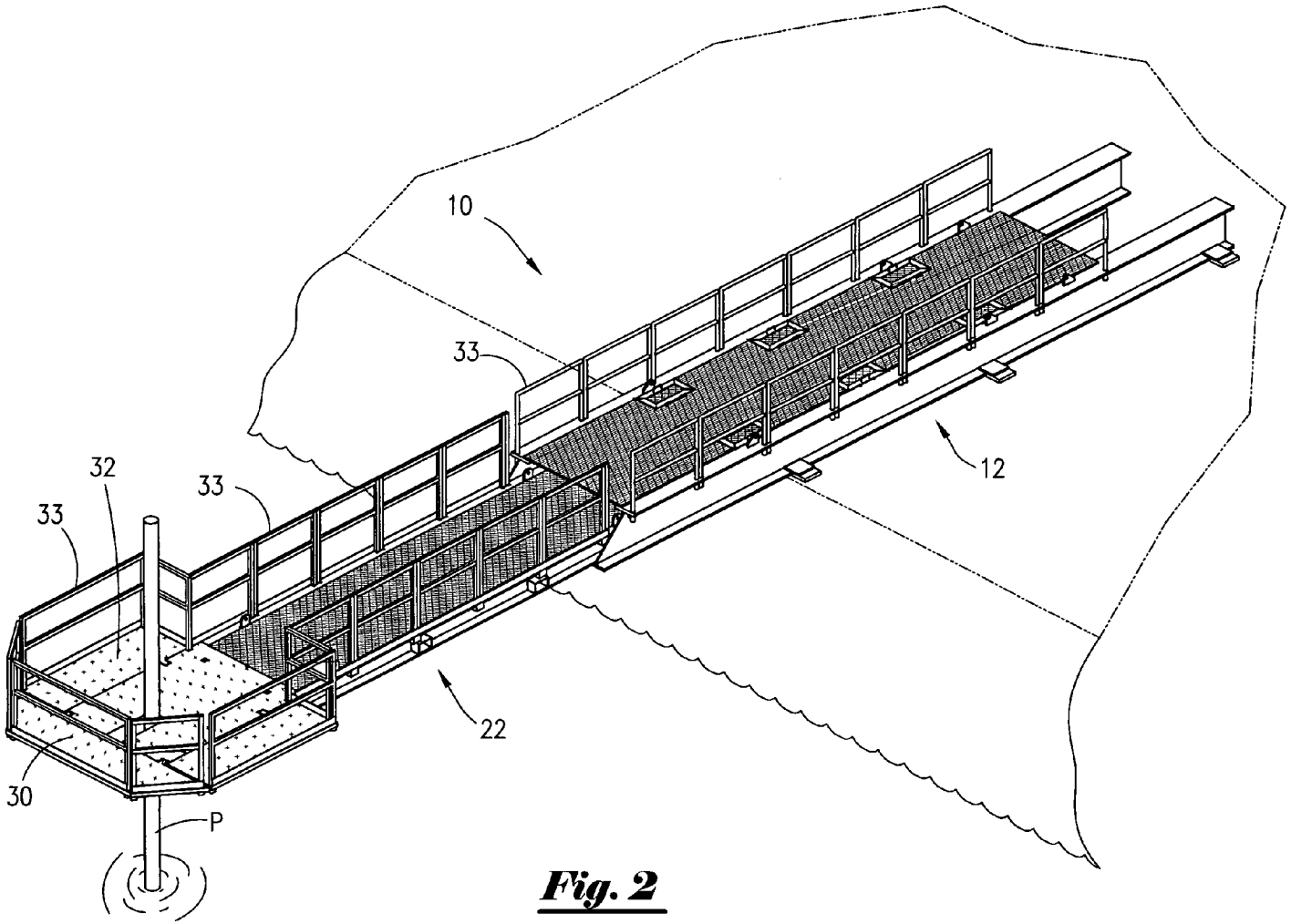
FIG. 2 is a perspective view of the extendable and retractable work platform of FIG. 1 in place at a work location.
Figure 3A:
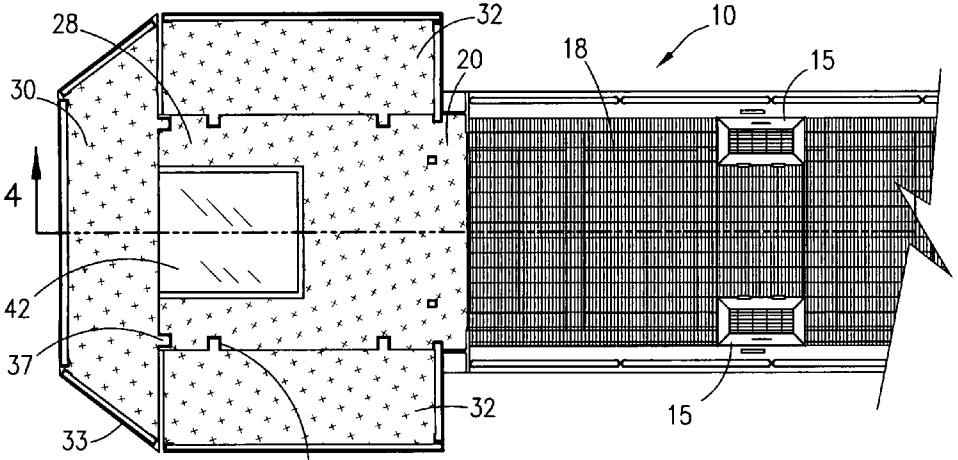
FIGS. 3A and 3B are top views of the work platform with the work deck in a retracted and fully deployed position.
Figure 3B:
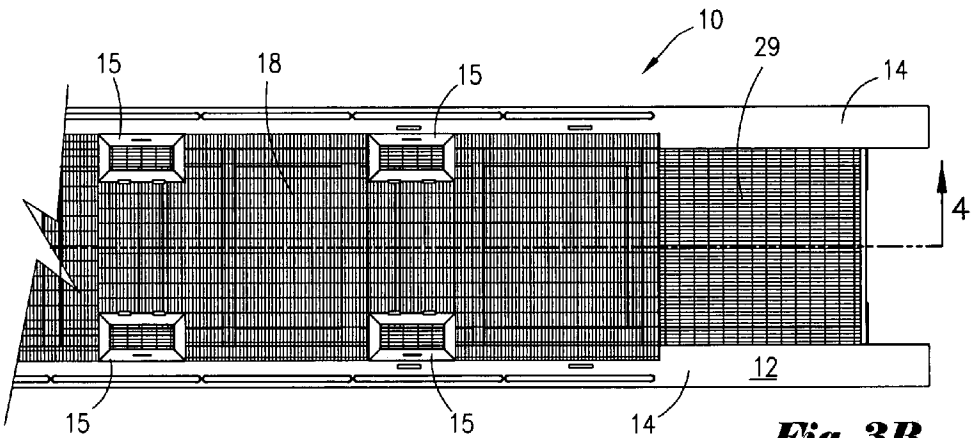
Figure 4A:
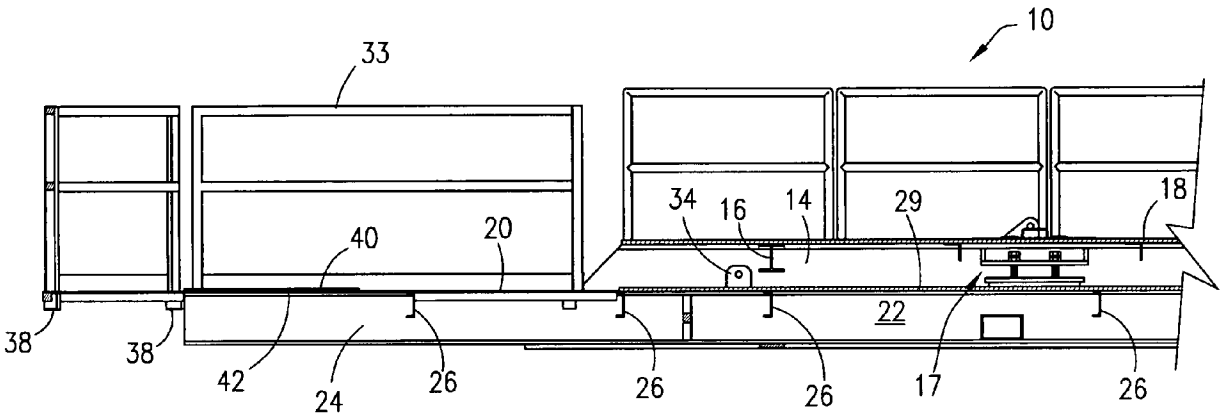
FIGS. 4A and 4B are longitudinal cross-section views of the work platform shown in FIGS. 3A and 3B.
Figure 4B:
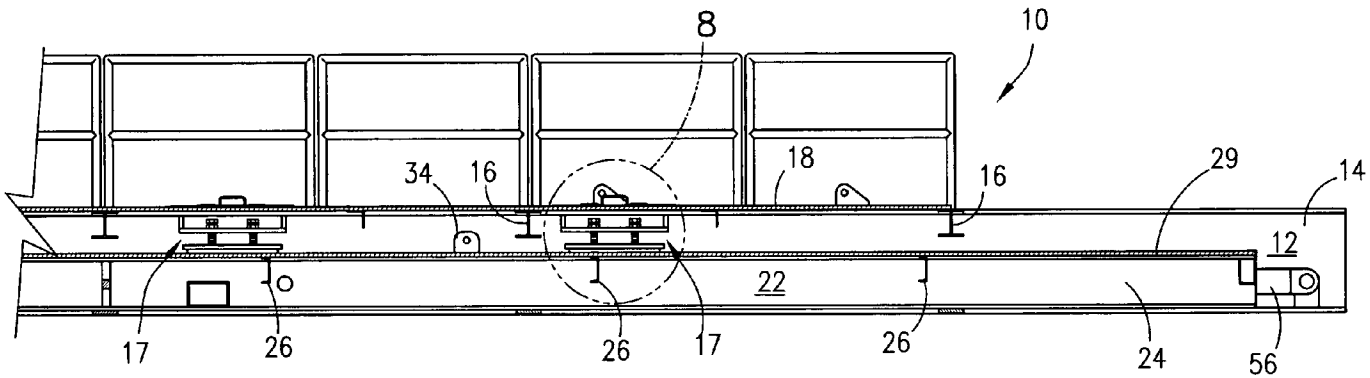
Figure 5A:
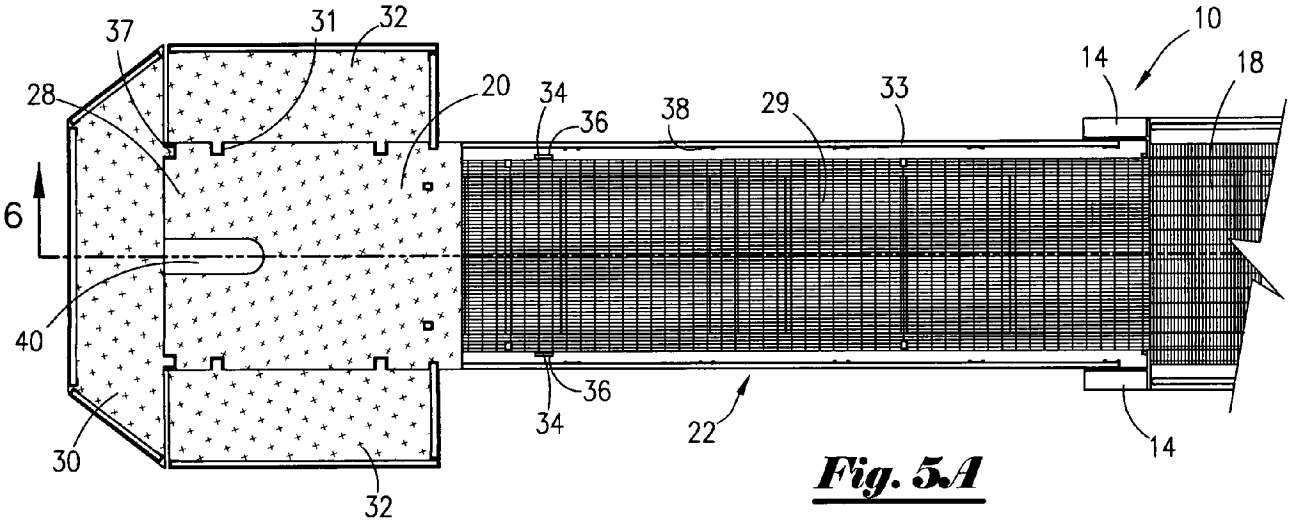
FIGS. 5A and 5B are top views of the work platform with the work deck in an extended and fully deployed position.
Figure 5B:
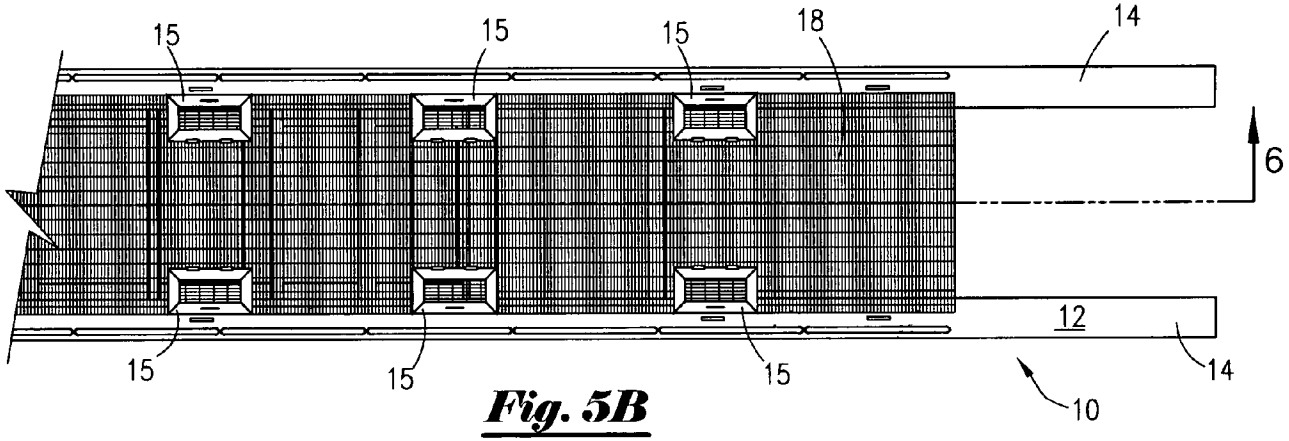
Figure 6A:
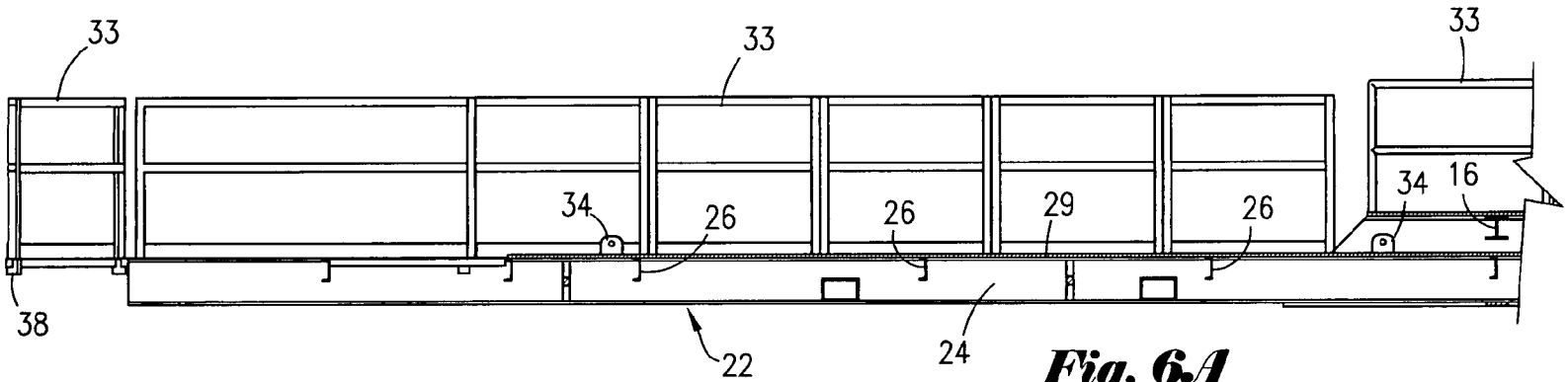
FIGS. 6A and 6B are longitudinal cross-section views of the work platform shown in FIGS. 5A and 5B.
Figure 6B:
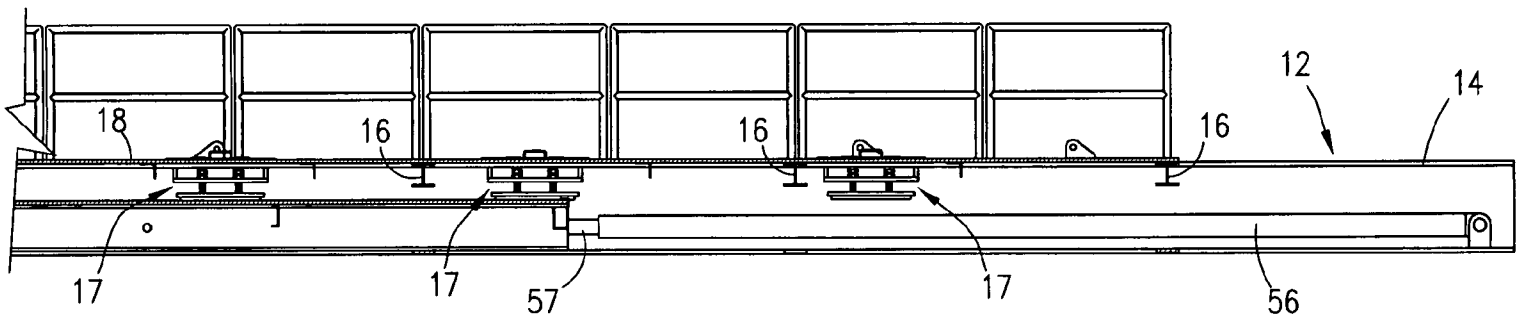

FIG. 1 and FIG. 2 shows the extendable and retractable work platform (10) mounted on the deck of a vessel (V) such as lift boat or type of work boat. The apparatus (10) is comprised of a first longitudinally extending support frame (12) having at least a pair of longitudinally extending support beams (14). The support frame (12) is attached to the deck of vessel (V) by welding, bolting, or other attachment means.

The support beams (14) of the support frame (12) are configured and positioned to slidably receive a slidably mounted work platform support frame (22). Floor braces are mounted to the support beams (12) of the support frame (14) to support a walkway floor or deck surface (18) as a work platform for workers. The deck surface (18) as shown in FIG. 1 and FIG. 2 is comprised of bar grating. However, checkered plate decking or a combination of checkered plate decking or bar grating might also be utilized for deck surface (18).

The work platform support frame (22) has longitudinally extending floor beams (24). Floor braces (26) are provided on the support frame (22). The floor braces (26) are configured to support walkway deck surfaces (20) and (29). This support frame (22) and walkway deck surfaces (20) and (29) provide an extendable and retractable work platform walkway for workers.

As shown in the drawings, walkway deck surface (20) is comprised of checkered plate decking and walkway deck surface (29) is comprised of bar grating. However, a combination of checkered plate decking or bar grating or other suitable flooring system might also be utilized for walkway deck surfaces (20) and (29).

The work platform support frame (22) of the apparatus (10) may be fitted with an expandable main work deck area (28.) The main work deck area (28) consisting of walkway deck surface (20) and attachable and detachable work deck extensions (30) and (32) will allow the main work deck area (28) to be tailored as needed. The main work deck area (28) may be provided with a variety of openings configured as may be desired such as a slot opening (40) to allow installation around a vertical work piece such as pipe (P) or a rectangular deck opening (42) to provide a means to drop equipment through the work deck area (28).

As shown in FIGS. 3A and 3*b* and FIGS. 5A and 58, plug and socket connections (31) on the work deck extensions (30) and (32) and the support frame (22) allow for the detachable mounting of the work deck extensions (30) and (32). Similarly, attachable and detachable hand rail sections (33) may be mounted around the walkway deck surfaces (18), (20) and (29) and the main work deck area (28) by means of sockets (38) on the support frames (12) and (22).

As shown in the drawings, particularly FIGS. 3A and 3B, 4A and 46, 5A and 5B, and 6A and 6B, the beams (14) of the support frame (12) of the work platform (10) are configured to slidably receive the beams (24) of the work platform support frame (22). This configuration allows the length of the work platform (10) to be "telescopically" extended and retracted to and from said vessel by pulling or pushing said work platform support frame (22) into and from the support frame (12). This will allow the work deck area (28) to be positioned at a desired point away from the vessel to which the platform (10) is mounted.

As shown in FIGS. 4A and 4B and FIGS. 6A and 6B, at least one linear hydraulic motor or hydraulic cylinder (56) having and extendable and retractable ram or piston (57) may be utilized to "telescopically" extend and retract work platform support frame (22) from and into support frame (12) in order to allow said second support frame (22) to be extended away from the vessel (V). This is accomplished by mounting the cylinder (56) to the support frame (12) and the piston (57) to the support frame (22) so that the work platform support frame (22) may be pulled into and out of the support frame (12).

Other mechanisms such as rack and pinion systems (not shown) or a winch, cable, and pulley systems could also be utilized to extend and retract work platform support frame (22) from and into support frame (12). For instances, lug (34) may be attached to cable, wench and pulley system to extend and retract the work platform support frame (22).

Figure 7:
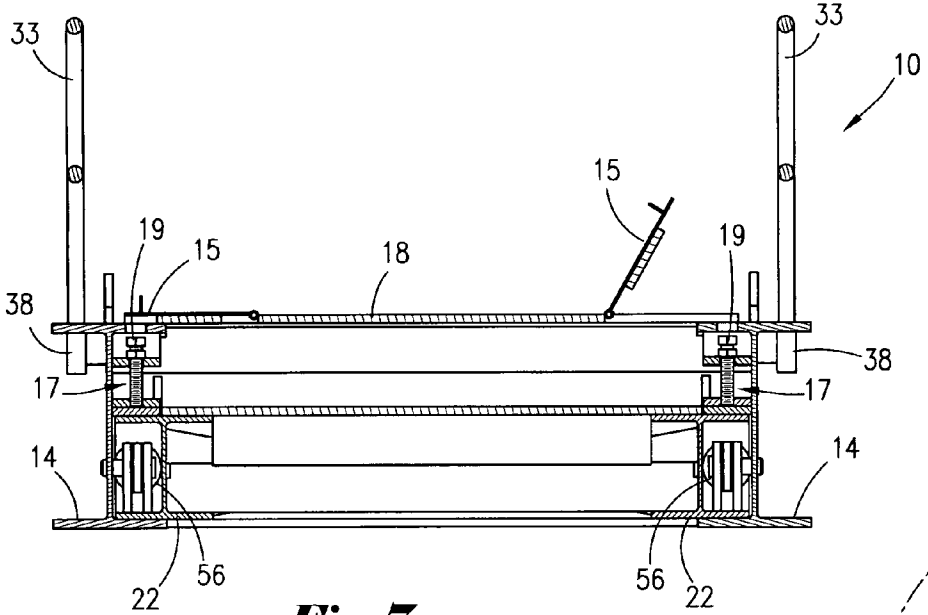
FIG. 7 is a transverse cross-section view of the extendable and retractable work platform shown in FIG. 1.

FIG. 7, a cross-section view of the first longitudinally extending support frame (12), shows longitudinal support beams (14) and support deck surface (18). The deck surface (18) is provided with an access hatch (15). The access hatch (15) provides access to the telescoping beam clamp (17).

Figure 8:
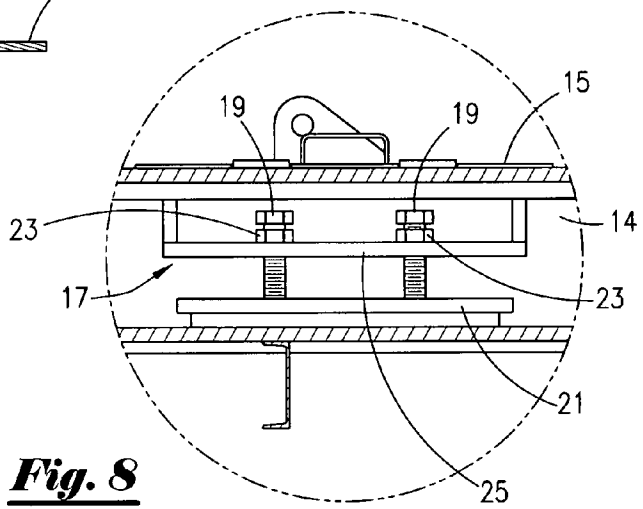
FIG. 8 is across-section view of a typical beam clamp assembly for extendable and retractable work platform shown in FIG. 1.

As shown in detail in FIG. 8, the beam clamp (17) is comprised of a beam clamp support plate (25) mounted to support beam (14). Attached to the beam clamp support plate (25) is a threadably positionable bearing plate (21) mounted on threaded clamp bolts (19). Clamp nuts (23) on the clamp bolts (19) threadably position the bearing plate (21) toward and away from the beam clamp support plate (25). This allows the bearing plate (21) to be selectively moved by means of threaded bolts (19) and clamp nuts (23) to bear against the top of the longitudinally extending floor beams (24) of support frame (22) to clamp and hold the support frame (22) is a desired position.

In use, as shown in FIGS. 1 and 2, the extendable and retractable work platform (10) is mounted to a vessel (V) such as a work boat, lift boat, or barge. The vessel (V) is then moved into a desired location with respect to a work area or work piece (P). The vessel (V) is then anchored or otherwise held in the desired location with respect to the work piece (P).

After the vessel (V) is held in the desired position, the bearing plate (21) of the beam clamp (17) is moved by means of threaded bolts (19) and clamp nuts (23) away from the top of the longitudinally extending floor beams (24) of support frame (22). Then the work platform support frame (22), with the associated walkway deck surfaces (20) and (29), is moved is extended from the support frame (12) and said vessel (V) toward the work area. By way of example, extension of the piston (57) in the hydraulic cylinder (56) will extend the support frame (22) from the support frame (12). Once the support frame (22) is extended as described, the bearing plate (21) of the beam clamp (17) is moved by means of threaded bolts (19) and clamp nuts (23) toward the top of the longitudinally extending floor beams (24) of support frame (22) to clamp the support frame in place with respect to the support frame (12).

The main work deck area (28) consisting of walkway deck surface (20) may then be expanded by the addition of the detachable work deck extensions (30) and (32) by means of plug and socket connections (31) to allow the main work deck area (28) to be tailored as needed. Slot opening (40) may be provided around the work piece (P) for the work area (28). Detachable hand rail sections (33) may then be mounted around the walkway deck surfaces (18), (20) and (29) and the main work deck area (28) by means of sockets (38) on the support frames (12) and (22) as a safety measure.

When desired, the apparatus (10) may be relocated by removing the hand rail sections (33) and the work deck extensions (30) and (32), moving the bearing plate (21) of the beam clamp (17) to unclamp the support frame (22) and then retracting the work platform support frame (22), with the associated walkway deck surfaces (20) and (29), into the support frame (12). This may be accomplished by retracting the piston rod (57) of the hydraulic cylinder (56). The bearing plate (21) of the beam clamp (17) can then be moved to clamp the support frame (22) to the support frame (12).

It is thought that the extendable and retractable work platform apparatus and the method of the present invention and many of its attendant advantages will be understood from the foregoing description. It is also thought that one may make various changes in the form, construction and arrangement of the parts of the cable protector apparatus and system without sacrificing its material advantages or departing from the spirit and scope of the invention and that the form described herein is merely an exemplary embodiment of the invention.

I claim:

1. An extendable and retractable work platform comprising:

(a) a first longitudinally extending support frame, said first support frame having at least a pair of longitudinally extending support beams, said support beams mounted to a deck of a vessel;

(b) a deck surface mounted to said first support frame;

(c) a second longitudinally extending support frame, whereby said second longitudinally extended support frame is cantilevered from said first longitudinally extending support frame, said second support frame having at least a pair of longitudinally extending support beams, said first and second support frames being configured so as to allow said second frame to be slidably received within said first support frame;

(d) a deck surface mounted to said second support frame;

(e) clamps for holding said second support frame in position with respect to said first support frame;

(f) means for extending said second longitudinal support frame from said first longitudinal support frame and for retracting said second longitudinal support frame into said first longitudinal support frame;

(g) a plurality of variously configured attachable and detachable deck sections, said attachable and detachable deck sections being selectively mountable to said second longitudinal support frame;

(h) a plurality of variously configured attachable and detachable hand rail sections, said attachable and detachable hand rail sections being selectively mountable around the periphery of said first and said second longitudinal support frames, walkway deck surfaces, and main work deck area; and (i) wherein said deck of said second support frame is provided with said attachable and detachable deck sections which can be removed to create an opening in said secondary support deck of a desired configuration.

2. The apparatus as recited in claim 1 wherein said means for extending said second longitudinal support frame from said first longitudinal support frame and for retracting said second longitudinal support frame into said first longitudinal support frame includes a hydraulic ram and piston assembly.

3. The apparatus as recited in claim 1 wherein each of said clamps is comprised of:

(a) a clamp support plate mounted on said first support frame;

(b) a clamp bearing plate;

(c) threaded clamp bolts having clamp bolt nuts attached to said clamp bearing and said clamp support plate said bearing plate may be moved toward and away from said second support frame with respect to said clamp support plate by turning said clamp bolt nuts on said clamp bolt.

* * * * *